US005945245A

United States Patent [19]

Mychajlowskij et al.

[11] Patent Number: 5,945,245

[45] Date of Patent: Aug. 31, 1999

[54] TONER PROCESSES

[75] Inventors: Walter Mychajlowskij, Mississauga; Guerino G. Sacripante, Oakville; Daniel A. Foucher, Toronto; Raj D. Patel, Oakville; Stephan V. Drappel, Toronto, all of Canada

[73] Assignee: Xerox Corporation, Stamford, Conn.

[21] Appl. No.: 09/006,640

[22] Filed: Jan. 13, 1998

[51] Int. Cl.[6] ..... G03G 9/087

[52] U.S. Cl. ..... 430/137; 430/106

[58] Field of Search ..... 430/137, 106; 523/334, 335

[56] References Cited

U.S. PATENT DOCUMENTS

| | | | |
|---|---|---|---|
| 4,137,188 | 1/1979 | Uetake et al. | 252/62.1 P |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,593,807 | 1/1997 | Sacripante et al. | 430/137 |
| 5,648,193 | 7/1997 | Patel et al. | 430/137 |
| 5,650,255 | 7/1997 | Ng et al. | 430/137 |
| 5,650,256 | 7/1997 | Veregin et al. | 430/137 |
| 5,658,704 | 8/1997 | Patel et al. | 430/137 |
| 5,660,965 | 8/1997 | Mychajlowskij et al. | 430/137 |

*Primary Examiner*—John Goodrow
*Attorney, Agent, or Firm*—E. O. Palazzo

[57] ABSTRACT

A surfactant free process for the preparation of toner comprising heating a mixture of an emulsion latex, a colorant, and an organic complexing agent.

30 Claims, No Drawings

TONER PROCESSES

PENDING APPLICATIONS AND PATENTS

The following copending applications, the disclosures of which are totally incorporated herein by reference, are being filed concurrently herewith. The appropriate components and processes of the following copending applications and patents may be selected for the present invention in embodiments.

U.S. Pat. No. 5,840,462 discloses a toner process wherein a colorant is flushed into a sulfonated polyester, followed by the addition of an organic soluble dye and an alkali halide solution.

U.S. Pat. No. 5,853,944 discloses a toner process with a first aggregation of sulfonated polyester, and thereafter, a second aggregation with a colorant dispersion and an alkali halide.

U.S. Ser. No. 09/006,299 discloses a toner process wherein there is mixed an emulsion latex and colorant dispersion, and wherein the colorant dispersion is stabilized with submicron sodio sulfonated polyester resin particles, and wherein the latex resin can be a sodio sulfonated polyester.

Also, illustrated in copending application U.S. Ser. No. 08/960,754 and U.S. Pat. No. 5,766,818 the disclosures of which are totally incorporated herein by reference, are cleavable surfactants and the use thereof in emulsion/aggregation/coalescence processes.

Illustrated in U.S. Pat. No. 5,658,704, the disclosure of which is totally incorporated herein by reference, is a process for the preparation of toner comprised of i) flushing pigment into a sulfonated polyester resin, and which resin has a degree of sulfonation of from between about 0.5 and about 2.5 mol percent based on the repeat unit of the polymer;

ii) dispersing the resulting pigmented sulfonated polyester resin in warm water, which water is at a temperature of from about 40 to about 95° C., and which dispersing is accomplished by a high speed shearing polytron device operating at speeds of from about 100 to about 5,000 revolutions per minute thereby enabling the formation of toner sized particles, and which particles are of a volume average diameter of from about 3 to about 10 microns with a narrow GSD;

iii) recovering said toner by filtration;

iv) drying said toner by vacuum; and v) optionally adding to said dry toner charge additives and flow aids.

Illustrated in U.S. Pat. No. 5,648,193, the disclosure of which is totally incorporated herein by reference, is a process for the preparation of toner compositions comprised of (i) flushing pigment into a sulfonated polyester resin, and which resin has a degree of sulfonation of from between about 2.5 and 20.0 mol percent based on the repeat unit of the polymer; (ii) dissipation of the resulting pigmented sulfonated polyester in water at about 40 to about 75° C. to obtain particles which are in the size range of about 50 to 200 nanometers; (iii) followed by cooling the resulting mixture below about the glass transition temperature of the sulfonated polyester; and adding, dropwise, a metal salt halide such as a magnesium chloride solution to form particles of a volume average diameter of from about 3 to about 10 microns with a narrow GSD; (iv) recovering the toner particles by filtration; (v) drying the toner particles by vacuum; and (vi) optionally adding to the dry toner particles charge additives and flow aids.

BACKGROUND OF THE INVENTION

The present invention is generally directed to toner processes, and more specifically, to aggregation and coalescence processes for the preparation of toner compositions. In embodiments, the present invention is directed to the economical chemical in situ preparation of toners without known pulverization and/or classification methods, and wherein in embodiments toner compositions with a volume average diameter of from about 1 to about 25, and preferably from 1 to about 10 microns and narrow GSD of, for example, from about 1.14 to about 1.25 as measured on the Coulter Counter can be obtained. The resulting toners can be selected for known electrophotographic imaging, digital, printing processes, including color processes, and lithography. The aforementioned toners are especially useful for the development of colored images with excellent line and solid resolution, and wherein substantially no background deposits are present.

In reprographic technologies, such as xerographic and ionographic devices, toners with volume average diameter particle sizes of from about 9 microns to about 20 microns are effectively utilized. Moreover, in xerographic technologies, such as the high volume Xerox Corporation 5090 copier-duplicator, high resolution characteristics and low image noise are highly desired, and can be attained utilizing the small sized toners of the present invention with, for example, a volume average particle diameter of from about 2 to about 11 microns and preferably less than about 7 microns, and with a narrow geometric size distribution (GSD) of from about 1.16 to about 1.3. Additionally, in xerographic systems wherein process color is utilized, such as pictorial color applications, small particle size colored toners, preferably of from about 3 to about 9 microns, are desired to avoid, or minimize paper curling. Also, it is preferable to select small toner particle sizes, such as from about 1 to about 7 microns, and with higher colorant loading, such as from about 5 to about 12 percent by weight of toner, such that the mass of toner layers deposited onto paper is reduced to obtain the same quality of image and resulting in a thinner plastic toner layer on paper after fusing, thereby minimizing or avoiding paper curling. Toners prepared in accordance with the present invention enable in embodiments the use of lower image fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color applications, and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably for example, of from about 3 to about 5 microns and fixing thereafter, results in a low gloss toner image of from about 1 to about 30 gloss units as measured by the Gardner Gloss metering unit. Alternatively, when higher image gloss is desired, such as from about 31 to about 60 gloss units as measured by the Gardner Gloss metering unit, higher gloss paper is utilized, such as from about 30 to about 60 gloss units, and which after image formation with small particle size toners of the present invention of preferably, for example, from about 3 to about 5 microns, (volume average diameter) and fixing thereafter results in a higher gloss toner image of from about 30 to about 60 gloss units as measured by the Gardner Gloss metering unit. The aforementioned toner to paper matching can be attained with, for example, small particle size toners, such as less than about 7 microns and preferably less than about 5 microns, such as from about 1 to about 4 microns, whereby the pile height of the toner layer or layers is considered low and acceptable.

PRIOR ART

Numerous processes are known for the preparation of toners, such as, for example, conventional polyester processes wherein a resin is melt kneaded or extruded with a pigment, micronized and pulverized to provide toner particles with a volume average particle diameter of from about 9 microns to about 20 microns and with broad geometric size distribution of from about 1.26 to about 1.5. In these processes, it is usually necessary to subject the aforementioned toners to a classification procedure such that a toner geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 10 microns, lower toner yields may be obtained after classification, such as from about 50 percent to about 70 percent. With the processes of the present invention in embodiments, small average particle sizes of, for example, from about 3 microns to about 9 microns, and preferably 5 microns are attained without resorting to classification processes, and wherein narrow geometric size distributions are attained, such as from about 1.16 to about 1.30, and preferably from about 1.16 to about 1.25. High toner yields also result, such as from about 90 percent to about 98 percent in embodiments of the present invention. In addition, by the toner particle preparation process of the present invention in embodiments, small particle size toners of from about 3 microns to about 7 microns can be economically prepared in high yields, such as from about 90 percent to about 98.9 percent by weight based on the weight of all the toner ingredients, such as toner resin and colorant.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. The disadvantage, for example, of poor GSD requires classification resulting in low toner yields, reference for example U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by specific suspension polymerization.

Illustrated in U.S. Pat. No. 5,593,807, the disclosure of which is totally incorporated herein by reference in its entirety, is a process for the preparation of toner compositions comprising, for example, (i) preparing an emulsion latex comprised of sodio sulfonated polyester resin particles of from about 5 to about 500 nanometers in size diameter by heating said resin in water at a temperature of from about 65° C. to about 90° C.;

(ii) preparing a pigment dispersion in water by dispersing in water from about 10 to about 25 weight percent of sodio sulfonated polyester and from about 1 to about 5 weight percent of pigment;

(iii) adding the pigment dispersion to the latex mixture with shearing, followed by the addition of an alkali halide in water until aggregation results as indicated, for example, by an increase in the latex viscosity of from about 2 centipoise to about 100 centipoise;

(iv) heating the resulting mixture at a temperature of from about 45° C. to about 55° C. thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying. The sulfonated polyesters of this patent may be selected for the processes of the present invention.

The process of the above patent may be disadvantageous in that, for example, the use of an alkali metal can result in a final toner resin which evidences some crosslinking or elastic reinforcement, primarily since the metal salt functions as a crosslinked site between the sulfonate groups contained on the polyester resin, causing an increase in viscosity and a decrease, or loss of high gloss characteristics for the polyester resin. These and other disadvantages and problems are minimized, or avoided with the processes of the present invention.

In U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites. The appropriate polyesters of this patent may be selected for the processes of the present invention.

Emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners). The appropriate components and processes of these Xerox Corporation patents may be selected for the invention of the present application in embodiments thereof.

SUMMARY OF THE INVENTION

It is a feature of the present invention to provide toner processes with many of the advantages illustrated herein.

In another object of the present invention there are provided simple and economical processes for the preparation of black and colored toner compositions with, for example, excellent colorant dispersion and narrow GSD.

In another feature of the present invention there are provided simple and economical in situ processes wherein reduced amounts of surfactants are selected for black and colored toner compositions by an emulsion aggregation process, and wherein a sulfonated polyester is selected as the resin, reference for example copending patent application U.S. Ser. No. 221,595, the disclosure of which is totally incorporated herein by reference.

In a further feature of the present invention there is provided a process for the preparation of sulfonated polyester containing toner compositions with a volume average diameter of from between about 1 to about 20 microns, and preferably from about 1 to about 7 microns in volume average diameter, and with a narrow GSD of, for example, from about 1.15 to about 1.35, and preferably from about 1.14 to about 1.22 as measured by a Coulter Counter.

In a further feature of the present invention there is provided a process for the preparation of toner compositions with certain effective particle sizes by controlling the temperature of the aggregation/coalescence, which process comprises stirring and heating at a suitable aggregation/coalescence temperature.

In a further feature of the present invention there is provided a process for the preparation of toners with particle size distribution which can be improved from about 1.4 to about 1.16 as measured by the Coulter Counter by increasing the temperature of aggregation/coalescence from about 25° C. to about 60° C. and preferably from about 45° C. to about 55° C.

In a further feature of the present invention there is provided a process that is rapid, for example the aggregation/coalescence time can be reduced to from about 1 to about 3 hours by increasing the temperature from room, about 25° C., (RT) to about 50° C. to about 60° C., and wherein the process consumes from about 1 to about 8 hours.

Moreover, in a further feature of the present invention there is provided an economical process for the preparation of toner compositions, which after fixing to paper substrates results in images with a gloss of from GGU (Gardner Gloss Units) up to 70 GGU as measured by Gardner Gloss meter matching of toner and paper.

In another feature of the present invention there is provided a composite toner of polymeric resin with colorant, such as pigment or dye, and optional charge control agents in high yields of from about 90 percent to about 100 percent without resorting to classification, and wherein surfactants are avoided; and there are provided processes for dissipating a polar charged sodium sulfonated polyester resin in water at about 10° C. to about 25° C. above the Tg of the polyester resin to form an emulsion latex, followed by mixing with pigment and organic complexing agen, and thereafter heating the mixture to from 30° C. to about 65° C. and preferably from 45° C. to about 55° C. to effect aggregation/coalescence of the emulsion particles and colorant to form coalesced toner particles of resin and colorant in the size range of, for example, from 1 to about 10 microns and preferably from about 3 to about 7 microns.

In yet another feature of the present invention there are provided toner compositions with low fusing temperatures of from about 110° C. to about 150° C. and with excellent blocking characteristics at from about 50° C. to about 60° C.

Another feature of the present invention resides in the use of organic small molecules as a coagulant which eliminates the crosslinking that is exhibited, for example, by the use of a dication salt.

Yet another feature of the present invention resides in the preparation of reduced surfactant, or substantially free surfactant latexes, thereby reducing or eliminating extensive washings.

These and other features of the present invention are accomplished in embodiments by the provision of toners and processes thereof. In embodiments of the present invention, there are provided processes for the economical direct preparation of toner compositions by flocculation or heterocoagulation, and coalescence.

The present invention is directed to processes for the preparation of toner compositions, which comprises initially attaining or generating a colorant, such as a pigment dispersion, for example, by dispersing an aqueous mixture of a colorant, especially pigment or pigments, such as carbon black like REGAL 330® obtained from Cabot Corporation, red, green, blue, orange, phthalocyanine, quinacridone or RHODAMINE B™, and generally cyan, magenta, yellow, or mixtures thereof, by utilizing a high shearing device, such as a Brinkmann Polytron, thereafter shearing this mixture by utilizing a high shearing device, such as a Brinkmann Polytron, a sonicator or microfluidizer with a suspended resin mixture comprised of a polyester polymer component, adding an organic complexing agent, and subsequently heating to enable aggregation/coalescence.

Moreover, the present invention is directed to a substantially free toner surfactant process by forming a latex of a polyester, such as a sodium sulfonated polyester resin in water, mixing the latex with a colorant, especially pigment dispersion containing a coagulating organic complexing agent, especially small molecules, and thereafter, heating the resulting mixture to primarily enable the generation of toner aggregates and coalesced toner particles. The polyester resin selected preferably contains sulfonated groups thereby rendering them dissipatable, that is, they form spontaneous emulsions in water without the use of organic solvents, especially above the glass transition temperature, Tg, of the polyester resin. The process of the present invention can be considered a substantially surfactant free chemical method wherein sulfopolyester particles are aggregated and coalesced with organic complexing agents in the presence of a colorant dispersion by heating wherein during the heating no surfactants are utilized. Heating the mixture at temperatures of from 45° C. to 55° C generates toner size particles with, for example, an average particle volume diameter of from about 1 to about 25 and preferably about 2 to about 10 microns. It is believed that during the heating the components of the sulfonated polyester latex and the colorant dispersion aggregate and fuse together to form composite toner particles. Additionally, it is believed the complex agents, such as a primary alkyl amino or diamino alkanes, cause the sulfonated polyester latex and colorant to aggregate and coalesce into a toner composite, or toner particles by an amidation hydrolysis of the polyester resin latex. More specifically, it is believed that the alkyl amine reacts with the ester moiety of the polyester resin latex to result in an amide bond or the partial hydrolysis of the resin. In another embodiment thereof, the present invention is directed to an in situ process comprised of first dispersing a colorant like a pigment, such as HELIOGEN BLUE™ or HOSTAPERM PINK™, reference the Color Index, in an aqueous mixture utilizing a high shearing device, such as a Brinkmann Polytron, microfluidizer or sonicator, thereafter shearing this mixture with a latex of suspended polyester resin particles, and which particles are preferably, for example, of a size ranging from about 5 to about 500 and more preferably about 10 to about 250 nanometers in volume average diameter, as measured by the Brookhaven nanosizer. Thereafter, the aforesaid mixture is contacted with an organic complexing agent, and heated with stirring for a suitable time period of, for example, from about 1 to about 8 hours, and which heating is, for example, from about 40° C. to about 60° C., and preferably from 45° C. to about 55° C., thereby resulting in the aggregation and simultaneous coalescence of the resin particles with the colorant, and permitting the formation of particles ranging in size of from about 0.5 micron to about 20 microns and preferably from 2 to about 10 microns in volume average diameter size as measured by the Coulter Counter (Microsizer II). The size of the coalesced particles and their distribution can be controlled by, for example, the amount of organic complexing agent and by the temperature of heating, and wherein the speed at which toner size particles are formed can also be controlled by the quantity of organic complexing agent used and by the temperature. The particles obtained after heating can be subjected to washing with, for example, water to remove residual organic complexing agent, and drying whereby there are obtained toner particles comprised of resin and colorant, and which toner can be of various particle size diameters, such as from 1 to about 20, and preferably about 12 microns in volume average particle diameter.

The processes of the present invention comprise (i) preparing an emulsion latex comprised of sodio sulfonated polyester resin particles of a size of from about 5 to about 300 nanometers, and preferably 10 to about 250 nanometers, and in an amount of from about 5 to about 40 weight percent by heating the resin in water at a temperature of from about 45° C. to about 80° C.;

(ii) adding, with shearing, or extensive high speed mixing, a colorant dispersion containing, for example, about 20 to about 50 percent of predispersed colorant in water, with a mean colorant size ranging from about 50 to about 150 nanometers, to the latex mixture comprised of sulfonated polyester resin particles in water, followed by the addition of an organic complexing agent in an amount, for example, of from about 1 to about 5 weight percent in water;

(iii) heating the above resulting mixture at a temperature of, for example, from about 35° C. to about 60° C. and preferably from about 45° C to about 55° C. thereby causing aggregation and coalescence resulting in toner particles of, for example, from about 4 to about 10 microns in size with a geometric distribution of less than about 1.3; and optionally (iv) cooling the product mixture to about 25° C., followed by isolating, filtering and drying; (i) preparing, or providing an emulsion latex of sodio sulfonated polyester resin particles of a size of from about 5 to about 500 nanometers and preferably from about 10 to about 250 nanometers in size diameter by heating the resin in water at a temperature of from about 65° C. to about 90° C.;

(ii) adding the colorant dispersion to the above latex mixture and to an organic complexing agent in water;

(iii) heating the resulting mixture at a temperature of from about 35° C. to about 60° C. and preferably from about 45° C. to about 55° C. thereby causing aggregation and enabling coalescence, resulting in toner particles of, for example, from about 4 to about 9 microns in volume average diameter and with a geometric distribution of less than about 1.3; and (iv) cooling the product mixture to about 25° C., followed by filtering and drying; a surfactant free process comprising (i) preparing an emulsion latex comprised of sodio sulfonated polyester resin particles of less than about 0.1 micron in size by heating the resin in water at a temperature of, for example, from about 5° C. to about 30° C. and preferably from about 10C. to about 20° C. above the resin glass transition temperature;

(ii) adding a colorant dispersion to the latex mixture, followed by the addition of an organic complexing component of from about 1 to about 5 weight percent in water;

(iv) heating the resulting mixture at a temperature of from about 35° C. to about 60° C. and preferably from about 45° C. to about 55° C. causing aggregation and coalescence thereby resulting in toner particles, and (v) cooling the product mixture, followed by filtering and drying; and a process for the preparation of toner compositions comprising (i) preparing an emulsion latex comprised of sodio sulfonated polyester resin particles and water by heating;

(ii) adding the pigment dispersion to the above latex mixture comprised of sulfonated polyester resin particles in water with shearing, followed by the addition of an organic complexing agent; and (iii) heating the resulting mixture thereby causing aggregation and enabling coalescence.

A surfactant free process for the preparation of toner comprises heating a mixture of an emulsion latex, a colorant, and an organic complexing agent; and the present invention also relates to a process wherein said complexing agent and said heating enables aggregation and coalescence of said resin particles and said colorant, and thereafter cooling and isolating the toner formed, and wherein said latex contains sulfonated polyester resin; a process for the preparation of toner compositions comprising (i) preparing an emulsion latex comprised of sodio sulfonated polyester resin particles of from about 5 to about 300 nanometers in size diameter by heating said resin in water at a temperature of from about 65° C. to about 90° C.;

(ii) adding with shearing to said latex a colorant dispersion containing from about 20 to about 50 percent of predispersed colorant in water and with a mean colorant size range of from about 50 to about 150 nanometers, followed by the addition of an organic complexing agent;

(iii) heating the resulting mixture at a temperature of from about 45° C. to about 65° C. thereby causing aggregation and enabling coalescence, resulting in toner particles of from about 2 to about 20 microns in volume average diameter; and (iv) cooling the toner product mixture followed by isolation, and drying; a process wherein the organic complexing agent is 1,4-diaminobutane, 1,4-diaminocyclohexane, 1,7-diaminoheptane, 1,6-diaminohexane, 1,2-diamino-2-methylpropane, 1,9-diaminononane, 1,8-diaminooctane, 1,5-diaminopentane, 1,2-diaminopropane, 1,3-diaminopropane, 1,3-diamino-2-hydroxypropane, ethanolamine, triethylamine, or tripropylamine; a process wherein the particle size distribution of the aggregated particles is about 1.40 decreasing to about 1.15, when the heating temperature is increased from room temperature, about 25° C. to about 55° C.; a process wherein said shearing is accomplished by homogenizing at from about 1,000 revolutions per minute to about 10,000 revolutions per minute, at a temperature of from about 25° C. to about 35° C., and for a duration of from about 1 minute to about 120 minutes; a process wherein the polyester is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-( 1,2-propylene-diethylene-terephthalate phthalate), copoly (ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate); a process wherein the polyester of (i) is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalate phthalate), copoly (ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate); a process wherein the colorant is carbon black, cyan, yellow, magenta, or mixtures thereof; a process wherein the toner particles isolated are from about 2 to about 15 microns in volume average diameter, and the geometric size distribution thereof is from about 1.15 to about 1.35; a process wherein there is added to the surface of the formed toner metal salts, metal salts of fatty acids, silicas, metal oxides, or mixtures thereof, each in an amount of from about 0.1 to about 10 weight percent of the obtained toner; a surfactant free process for the preparation of toner comprising admixing an emulsion latex comprised of sulfonated polyester resin particles with a colorant dispersion, and an organic complexing agent; and heating the resulting mixture at a temperature, and optionally (v) cooling the mixture; a process wherein said emulsion latex comprised of sulfonated polyester resin particles is generated by heating said resin particles in water at a temperature of from about 15 to about 30° C. above the resin glass transition temperature, wherein said colorant dispersion contains from about 20 to about 50 percent of predispersed colorant in water, followed by the addition of said organic complexing agent; heating the resulting mixture at a temperature of from about 35° C. to about 65° C. thereby causing aggregation and coalescence; and (v) cooling the resulting mixture; a process wherein there is prepared an emulsion latex comprised of sodio sulfonated polyester resin particles by heating said resin in water, and subsequent to cooling the toner is isolated and then dried; a process wherein isolation is by filtration and cooling is to about 25° C.; a process wherein the organic complexing agent enables non-crosslinked toner particles, or wherein said organic complexing agent enables toner which exhibits nonreinforcing Theological characteristics; a process wherein the complexing agent is selected in an amount of from about 1 to about 5 weight percent; a process wherein said polyester is a sodio sulfonated polyester resin of a size diameter of from about 10 to about 150 nanometers, and wherein said toner is from about 3 to about 12 microns in volume average diameter; a process wherein said organic complexing agent provides for the aggregation and coalescence of the resin latex and colorant by an amidation reaction of the polyester latex, and wherein said amidation involves the reaction of an amine group from the complexing agent with the ester bond of said polyester; a process wherein said organic complexing agent provides for the aggregation and coalescence of the resin latex and colorant by partial hydrolysis of the polyester latex, and wherein partial is from about 0.1 to about 2 weight percent; a process wherein said complexing agent enables the aggregation and coalescence of the resin latex and colorant; a process wherein said aggregation and coalescence results from the amidation of said resin of from about 0.1 to about 2 weight percent of said polyester; a process wherein the complexing agent is 1,3-diaminopentane; a process wherein the polyester resin is copoly(neopentylene-diethylene)terephthalate-copoly(sodium sulfoisophthalate dicarboxylate), or copoly(1,2-propylene-diethylene)terephthalate-copoly (sodium sulfoisophthalate dicarboxylate); a process wherein the polyester resin is of the formula

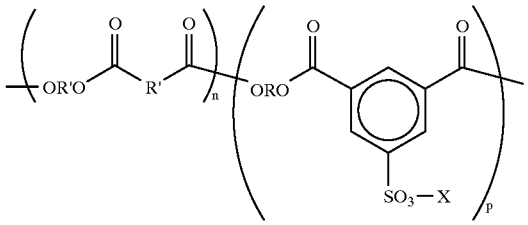

wherein R is an alkylene; R' is an arylene; and p and n represent the number of randomly repeating segments; and a process wherein said polyester resin is a random copolymer, and wherein the n and p segments are separated.

In some instances, colorants, such as pigments available in the wet cake form or concentrated form containing water, can be easily dispersed utilizing a homogenizer or stirring. In other embodiments, pigments are available in a dry form, whereby a dispersion in water is preferably effected by microfluidizing using, for example, an M-110 microfluidizer and passing the pigment dispersion from about 1 to about 10 times through the chamber of the microfluidizer, or by sonication, such as using a Branson 700 sonicator.

The preferred resin selected for the processes of the present invention is a sulfonated polyester, examples of which include those as illustrated in copending application U.S. Ser. No. 221,595, the disclosure of which is totally incorporated herein by reference, and the appropriate patents recited herein, such as a sodio sulfonated polyester, and more specifically, a polyester, such as poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene-sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), and copoly(propoxylated bisphenol A)-copoly-(propoxylated bisphenol A-sodio 5-sulfoisophthalate. The sulfonated polyesters may in embodiments be represented by the following formula, or random copolymers thereof wherein the n and p segments are separated

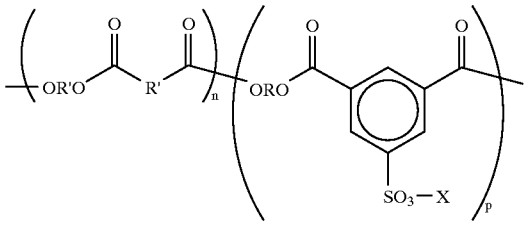

wherein R is an alkylene of, for example, from 2 to about 25 carbon atoms such as ethylene, propylene, butylene, oxyalkylene diethyleneoxide, and the like; R' is an arylene of, for example, from about 6 to about 36 carbon atoms, such as a benzylene, bisphenylene, bis(alkyloxy) bisphenolene, and the like; and p and n represent the number of randomly repeating segments, such as for example from about 10 to about 10,000. The alkali sulfopolyester possesses, for example, a number average molecular weight ($M_n$) of from about 1,500 to about 50,000 grams per mole, a weight average molecular weight ($M_w$) of from about 6,000 grams per mole to about 150,000 grams per mole as measured by gel permeation chromatography and using polystyrene as standards.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600 ™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are cyan, magenta, or yellows, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. These colorants, especially pigments, selected are present in various effective amounts as indicated herein, and generally from about 1 weight percent to about 65 weight and preferably from about 2 to about 12 percent, of the toner.

Colorants include dyes, pigments, mixtures thereof, mixtures of pigments, mixtures of dyes, and the like.

Examples of organic complexing agents, or components include aliphatic amines, especially diamines, aminoaliphatic alcohols, trialiphatic amines, and the like, and wherein aliphatic is an alkyl which contains, for example, from about 1 to about 25 carbon atoms. Specific examples of complexing agents are 1,4-diaminobutane, 1,4-diaminocyclohexane, 1,7-diaminoheptane, 1,6-diaminohexane, 1,2-diamino-2-methylpropane, 1,9-diaminononane, 1,8-diaminooctane, 1,5-diaminopentane, DYTEK™ obtained from DuPont, 1,2-diaminopropane, 1,3-diaminopropane, 1,3-diamino-2-hydroxypropane, ethanolamine, triethylamine, tripropylamine, and the like. The concentration, or amount of the complexing agent selected is in embodiments, for example from about 0.5 to about 10 percent by weight, and preferably from about 1 to about 5 percent by weight of the amount of the sulfonated polyester resin.

Surface additives that can be added to the toner compositions after isolation by, for example, filtration, and then optionally followed by washing and drying include, for example, metal salts, metal salts of fatty acids, colloidal silicas, titanium oxides, mixtures thereof, and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate, silicas, such as AEROSIL R972®, and other silicas available from Cabot Corporation Degussa Company. These additives can be selected in amounts of, for example, from about 0.1 to about 2 percent, and which additives can be incorporated during the aggregation, or blended into the formed toner product. The toner may also include known charge additives in effective amounts of, for example, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of each of these patents being totally incorporated herein by reference, negative charge enhancing additives like aluminum complexes, and the like. Other known positive and negative enhancing charge additives may also be selected.

Developer compositions can be prepared by mixing the toners obtained with the processes of the present invention with known carrier particles, including coated carriers, such as steel, ferrites, and the like, reference U.S. Pat. Nos.

4,937,166 and 4,935,326, the disclosures of which are totally incorporated herein by reference, for example from about 2 percent toner concentration to about 8 percent toner concentration. The carrier particles may also be comprised of a carrier core with a polymer coating, or coatings thereover, and dispersed therein a conductive component like a conductive carbon black in an amount, for example, of from about 5 to about 60 weight percent.

Imaging methods are also envisioned with the toners of the present invention, reference for example a number of the patents mentioned herein, and U.S. Pat. Nos. 4,265,660; 4,585,884; 4,563,408 and 4,584,253, the disclosures of which are totally incorporated herein by reference.

The following Examples are provided. These Examples are intended to be illustrative only and are not intended to limit the scope of the present invention. Also, parts and percentages are by weight unless otherwise indicated.

EXAMPLES

PREPARATION OF SULFONATED POLYESTERS

Moderately sulfonated polyesters prepared by polycondensation reactions were selected with a sufficient enough loading of sulfonate groups to afford ready dissipation of the polymer in warm water, for example about 5° C. to 10° C. >Tg of the polyester resin, to submicron particles.

Preparation of Linear Moderately Sulfonated Polyester A:

A linear sulfonated random copolyester resin comprised of, on a mol percent, approximately 0.47 of terephthalate, 0.030 of sodium sulfoisophthalate, 0.455 of neopentyl glycol, and 0.045 of diethylene glycol was prepared as follows. In a one liter Parr reactor equipped with a bottom drain valve, double turbine agitator, and distillation receiver with a cold water condenser were charged 388 grams of dimethylterephthalate, 44.55 grams of sodium dimethylsulfoisophthalate, 310.94 grams of neopentyl glycol (1 mole excess of glycol), 22.36 grams of diethylene glycol (1 mole excess of glycol), and 0.8 gram of butyltin hydroxide oxide as the catalyst. The reactor was then heated to 165° C. with stirring for 3 hours whereby 115 grams of distillate were collected in the distillation receiver, and which distillate was comprised of about 98 percent by volume of methanol and 2 percent by volume of neopentylglycol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 122 grams of distillate in the distillation receiver, and which distillate was comprised of approximately 97 percent by volume of neopentylglycol and 3 percent by volume of methanol as measured by the ABBE refractometer. The pressure was then further reduced to about 1 Torr over a 30 minute period whereby an additional 16 grams of neopentylglycol were collected. The reactor was then purged with nitrogen to atmospheric pressure, and the polymer discharged through the bottom drain onto a container cooled with dry ice to yield 460 grams of the 3.0 mol percent sulfonated-polyester resin, copoly(neopentylene-diethylene)terephthalate-copoly(sodium sulfoisophthalate dicarboxylate). The sulfonated polyester resin glass transition temperature was measured to be 54.7° C. (onset) utilizing the 910 Differential Scanning Calorimeter available from E.I. DuPont operating at a heating rate of 10° C. per minute. The number average molecular weight was measured to be 2,560 grams per mole, and the weight average molecular weight was measured to be 3,790 grams per mole using tetrahydrofuran as the solvent. A particle size of 31 nanometers (volume weighted) was measured using a Nicomp particle sizer.

Preparation of Linear Moderately Sulfonated Polyester B:

A linear sulfonated random copolyester resin comprised of, on a mol percent, approximately 0.465 of terephthalate, 0.035 of sodium sulfoisophthalate, 0.475 of 1,2-propanediol, and 0.025 of diethylene glycol was prepared as follows. In a one liter Parr reactor equipped with a bottom drain valve, double turbine agitator, and distillation receiver with a cold water condenser were charged 388 grams of dimethylterephthalate, 44.55 grams of sodium dimethylsulfoisophthalate, 310.94 grams of 1,2-propanediol (1 mole excess of glycol), 22.36 grams of diethylene glycol (1 mole excess of glycol), and 0.8 gram of butyltin hydroxide oxide as the catalyst. The reactor was then heated to 165° C. with stirring for 3 hours whereby 115 grams of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 122 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 16 grams of 1,2-propanediol were collected. The reactor was then purged with nitrogen to atmospheric pressure, and the polymer discharged through the bottom drain onto a container cooled with dry ice to yield 460 grams of the 3.5 mol percent sulfonated polyester resin, copoly(1,2-propylene-diethylene)terephthalate-copoly (sodium sulfoisophthalate dicarboxylate). The sulfonated polyester resin glass transition temperature was measured to be 59.5° C. (onset) utilizing the 910 Differential Scanning Calorimeter, available from E.I. DuPont, operating at a heating rate of 10° C. per minute. The number average molecular weight was measured to be 3,250 grams per mole, and the weight average molecular weight was measured to be 5,290 grams per mole using tetrahydrofuran as the solvent. A particle size of 57 nanometers (volume weighted) was measured using a Nicomp particle sizer.

Preparation of Latex Stock Solutions:

Submicron dispersions of the appropriate sulfonated polyester resin, for example those prepared above, in distilled deionized water are prepared by first heating the water to about 10° C. to about 15° C. above the glass transition of the sulfonated polyester polymer and then slowly adding the polymer with stirring until it has fully dispersed. The resulting latexes had a characteristic blue tinge and a resin particle size in the range of from about 5 to about 100 nanometers. In general 50 grams of the sulfonated polyester were dissipated in 200 grams of water.

Cyan Toner Preparation:

250 Grams of the above polyester resin B emulsion, or latex as prepared above were mixed with 3.25 grams of a cyan Pigment 15:3 dispersion (Sun Chemical 54 percent by weight pigment in water) followed by shearing at 3,000 revolutions per minute using a Brinkmann polytron for a duration of about 2 minutes. To this was added with stirring 2.25 grams of the organic complexing agent 1,3-diaminopentane, or DYTEK™ in about 10 milliliters of water. The resulting mixture was then heated to about 52° C. and stirring was then continued for 5.5 hours, resulting in cyan toner particles with an average particle size of about 6.6 microns and GSD of 1.18 as measured by the Coulter Counter. The cyan toner was comprised of about 96.5 weight percent of resin and 3.5 weight percent of cyan Pigment 15:3.

Collection of Product:

The above mixture was diluted with 500 milliliters of cold water cooled to room temperature, about 25° C., filtered, washed with about 500 grams of water and dried using a freeze dryer. There were achieved 50 gloss units at a low fusing temperature of about 170° C. when the toner obtained was fused on a Xerox Corporation laboratory fuser similar to the Xerox Corporation 5090 fuser. Thus, this toner was considered a high gloss toner.

Magenta Toner Preparation:

250 Grams of the polyester resin B latex as prepared above were mixed with 12 grams of a magenta Red 81:3 pigment dispersion (Sun Chemical 21 percent by weight pigment in water) followed by shearing at 3,000 revolutions per minute using a Brinkmann polytron for a duration of about 2 minutes. To the mixture resulting were added with stirring 2.25 grams of the organic complexing agent 1,3-diaminopentane, or DYTEK™, in about 10 milliliters of water. The resulting mixture was then heated to about 52° C., and stirring was then continued for 6 hours resulting in magenta toner particles with an average particle size of about 5.9 microns and GSD of 1.19 as measured by the Coulter Counter. The magenta toner was comprised of about 95 weight percent of the polyester resin and 5 weight percent of the red Pigment 81:3.

Collection of Product:

The above mixture was diluted with 500 milliliters of cold water cooled to room temperature, about 25° C., filtered, washed with about 500 grams of water and dried using a freeze dryer. There were achieved 50 gloss units at a low fusing temperature of about 175° C. when the above prepared magenta toner obtained was fused on a Xerox Corporation laboratory fuser similar to the Xerox Corporation 5090 fuser. Thus, this toner was considered a high gloss toner.

Yellow Toner Preparation:

250 Grams of the polyester resin B emulsion as prepared above were mixed with 10 grams of a Yellow 180 pigment dispersion (Sun Chemical 25 percent by weight pigment in water) followed by shearing at 3,000 revolutions per minute using a Brinkmann polytron for a duration of about 2 minutes. To this mixture were added with stirring 2.25 grams of the organic complexing agent DYTEK™in about 10 milliliters of water. The resulting mixture was then heated to about 52° C. and stirring was continued for 6.5 hours to result in yellow toner particles with an average particle size of about 6.2 microns and GSD of 1.17 as measured by the Coulter Counter. The resulting yellow toner was comprised of about 92.8 weight percent of the polyester resin and 7.2 weight percent of the Yellow 180 pigment.

Collection of Product:

The above mixture was diluted with 500 milliliters of cold water cooled to room temperature, about 25° C., filtered, washed with about 500 grams of water and dried using a freeze dryer. There were achieved 50 gloss units at a low fusing temperature of about 177° C. when the above prepared yellow toner obtained was fused on a Xerox Corporation laboratory fuser similar to the Xerox Corporation 5090 fuser. Thus, this toner was considered a high gloss toner.

Black Toner Preparation:

250 Grams of the polyester resin B emulsion as prepared above were mixed with 5 grams of a REGAL 330® carbon black pigment dispersion (Sun Chemical 40 percent by weight pigment in water) followed by shearing at 3,000 revolutions per minute using a Brinkmann polytron for a duration of about 2 minutes. To this mixture were added with stirring 2.25 grams of the organic complexing agent hexanediamine in about 10 milliliters of water. The resulting mixture was then heated to about 52° C., and stirring was continued for 6.5 hours to result in black toner particles with an average particle size of about 6.4 microns and GSD of 1.18 as measured by the Coulter Counter. The resulting black toner was comprised of about 95 weight percent of the polyester resin and 5 weight percent of the REGAL 330® carbon black.

Collection of Product:

The above mixture was diluted with 500 milliliters of cold water cooled to room temperature, about 25° C., filtered, washed with about 500 grams of water and dried using a freeze dryer. There were achieved 50 gloss units at a low fusing temperature of about 180° C. when the above prepared black toner obtained was fused on a Xerox Corporation laboratory fuser similar to the Xerox Corporation 5090 fuser. Thus, this toner was considered a high gloss toner.

Other embodiments and modifications of the present invention may occur to those of ordinary skill in the art subsequent to a review of the present application and the information presented herein; these embodiments modifications, and equivalents, or substantial equivalents thereof, are also included within the scope of this invention.

What is claimed is:

1. A surfactant free process for the preparation of toner comprising heating a mixture of an emulsion latex, a colorant, and an organic complexing agent.

2. A process in accordance with claim 1 wherein said complexing agent and said heating enables aggregation and coalescence of resin particles contained in the latex and said colorant, and thereafter cooling and isolating the toner formed, and wherein said latex contains sulfonated polyester resin.

3. A process for the preparation of toner compositions comprising (i) preparing an emulsion latex comprised of sodio sulfonated polyester resin particles of from about 5 to about 300 nanometers in size diameter by heating said resin in water at a temperature of from about 65° C. to about 90° C.;

(ii) adding with shearing to said latex a colorant dispersion containing from about 20 to about 50 percent of predispersed colorant in water and with a mean colorant size range of from about 50 to about 150 nanometers, followed by the addition of an organic complexing agent;

(iii) heating the resulting mixture at a temperature of from about 45° C. to about 65° C. thereby causing aggregation and enabling coalescence, resulting in toner particles of from about 2 to about 20 microns in volume average diameter; and (iv) cooling the toner product mixture followed by isolation, and drying.

4. A process in accordance with claim 1 wherein the organic complexing agent is 1,4-diaminobutane, 1,4-diaminocyclohexane, 1,7-diaminoheptane, 1,6-diaminohexane, 1,2-diamino-2-methylpropane, 1,9-diaminononane, 1,8-diaminooctane, 1,5-diaminopentane, 1,2-diaminopropane, 1,3-diaminopropane, 1,3-diamino-2-hydroxypropane, ethanolamine, triethylamine, or tripropylamine.

5. A process in accordance with claim 2 wherein the particle size distribution of the aggregated particles is about 1.40 decreasing to about 1.15, when the heating temperature is increased from room temperature, about 25° C. to about 55° C.

6. A process in accordance with claim 3 wherein said shearing is accomplished by homogenizing at from about 1,000 revolutions per minute to about 10,000 revolutions per minute, at a temperature of from about 25° C. to about 35° C., and for a duration of from about 1 minute to about 120 minutes.

7. A process in accordance with claim 2 wherein the polyester is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalate phthalate), copoly(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate).

8. A process in accordance with claim 3 wherein the polyester of (i) is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalate phthalate), copoly-(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate).

9. A process in accordance with claim 1 wherein the colorant is carbon black, cyan, yellow, magenta, or mixtures thereof.

10. A process in accordance with claim 1 wherein the toner particles isolated are from about 2 to about 15 microns in volume average diameter, and the geometric size distribution thereof is from about 1.15 to about 1.35.

11. A process in accordance with claim 1 wherein there is added to the surface of the formed toner metal salts, metal salts of fatty acids, silicas, metal oxides, or mixtures thereof, each in an amount of from about 0.1 to about 10 weight percent of the obtained toner.

12. A surfactant free process for the preparation of toner comprising admixing an emulsion latex comprised of sulfonated polyester resin particles with a colorant dispersion, and an organic complexing agent; and heating the resulting mixture; and optionally (v) cooling the mixture.

13. A process in accordance with claim 12 wherein said emulsion latex comprised of sulfonated polyester resin particles is generated by heating said resin particles in water at a temperature of from about 15 to about 30° C. above the resin glass transition temperature, wherein said colorant dispersion contains from about 20 to about 50 percent of predispersed colorant in water, followed by the addition of said organic complexing agent; heating the resulting mixture at a temperature of from about 35° C. to about 65° C. thereby causing aggregation and coalescence; and (v) cooling the resulting mixture.

14. A process in accordance with claim 12 wherein there is prepared an emulsion latex comprised of sodio sulfonated polyester resin particles by heating said resin in water, and subsequent to cooling the toner is isolated and then dried.

15. A process in accordance with claim 14 wherein isolation is by filtration and cooling is to about 25° C.

16. A process in accordance with claim 1 wherein the organic complexing agent enables noncrosslinked toner particles, or wherein said organic complexing agent enables toner which exhibits nonreinforcing rheological characteristics.

17. A process in accordance with claim 1 wherein the complexing agent is selected in an amount of from about 1 to about 5 weight percent.

18. A process in accordance with claim 1 wherein the latex contains polyester resin and wherein said polyester is a sodio sulfonated polyester resin of a size diameter of from about 10 to about 150 nanometers, and wherein said toner is from about 3 to about 12 microns in volume average diameter.

19. A process in accordance with claim 1 wherein said organic complexing agent provides for the aggregation and coalescence of the resin latex and colorant by an amidation reaction of the polyester latex, and wherein said amidation involves the reaction of an amine group from the complexing agent with the ester bond of said polyester.

20. A process in accordance with claim 1 wherein said organic complexing agent provides for the aggregation and coalescence of the resin latex and colorant by partial hydrolysis of the polyester latex, and wherein partial is from about 0.1 to about 2 weight percent.

21. A process in accordance with claim 1 wherein said complexing agent enables the aggregation and coalescence of the resin latex and colorant.

22. A process in accordance with claim 21 wherein said aggregation and coalescence results from the amidation of said resin of from about 0.1 to about 2 weight percent of said polyester.

23. A process in accordance with claim 1 wherein the complexing agent is 1,3-diaminopentane.

24. A process in accordance with claim 2 wherein the polyester resin is copoly(neopentylene-diethylene) terephthalate-copoly(sodium sulfoisophthalate dicarboxylate), or copoly(1,2-propylene-diethylene) terephthalate-copoly(sodium sulfoisophthalate dicarboxylate).

25. A process in accordance with claim 2 wherein the polyester resin is of the formula

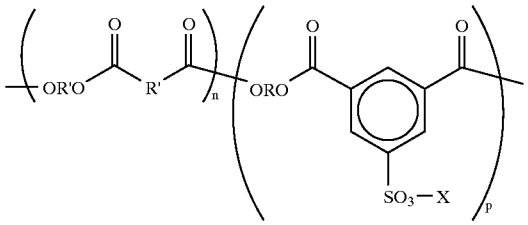

wherein R is an alkylene; R' is an arylene; and p and n represent the number of randomly repeating segments.

26. A process in accordance with claim 25 wherein said polyester resin is a random copolymer, and wherein the n and p segments are separated.

27. A process for the preparation of toner comprising heating a mixture of a latex, a colorant, and an inorganic complexing agent.

28. A process in accordance with claim 27 wherein said organic complexing agent is 1,4-diaminobutane, 1,4-diaminocyclohexane, 1,7-diaminoheptane, 1,6-diaminohexane, 1,2-diamino-2-methylpropane, 1,9-diaminononane, 1,8-diaminooctane, 1,5-diaminopentane, 1,2-diaminopropane, 1,3-diaminopropane, 1,3-diamino-2-hydroxypropane, ethanolamine, triethylamine, or tripropylamine.

29. A process in accordance with claim 1 wherein said complexing agent is 1,3-diaminopentane.

30. A surfactant free process for the preparation of toner comprising heating a mixture of an emulsion latex, a colorant, and an organic complexing agent wherein said organic complexing agent is 1,4-diaminobutane, 1,4-diaminocyclohexane, 1,7-diaminoheptane, 1,6-diaminohexane, 1,2-diamino-2-methylpropane, 1,9-diaminononane, 1,8-diaminooctane, 1,5-diaminopentane, 1,2-diaminopropane, 1,3-diaminopropane, 1,3-diamino-2-hydroxypropane, ethanolamine, triethylamine, or tripropylamine.

* * * * *